US008201500B2

(12) United States Patent
Bengtsson

(10) Patent No.: US 8,201,500 B2
(45) Date of Patent: Jun. 19, 2012

(54) POWDER CHARGED ROCK CRACKER CARTRIDGE

(76) Inventor: Jan-Åke Bengtsson, Herrljunga (SE)

( * ) Notice: Subject to any disclaimer, the term of this patent is extended or adjusted under 35 U.S.C. 154(b) by 0 days.

(21) Appl. No.: 12/933,089

(22) PCT Filed: Mar. 26, 2009

(86) PCT No.: PCT/SE2009/050309

§ 371 (c)(1),
(2), (4) Date: Nov. 3, 2010

(87) PCT Pub. No.: WO2009/120139

PCT Pub. Date: Oct. 1, 2009

(65) Prior Publication Data

US 2011/0036259 A1 Feb. 17, 2011

(30) Foreign Application Priority Data

Mar. 26, 2008 (SE) ..... 0800673

(51) Int. Cl.
*F42B 3/00* (2006.01)

(52) U.S. Cl. ..... 102/332; 102/322; 102/331; 102/321.1

(58) Field of Classification Search ..... 102/332
See application file for complete search history.

(56) References Cited

U.S. PATENT DOCUMENTS

| | | | | |
|---|---|---|---|---|
| 3,451,341 | A | 6/1969 | Dittman | |
| 3,517,616 | A | 6/1970 | Martin | |
| 5,763,816 | A | 6/1998 | Keeling | |
| 6,497,180 | B1 * | 12/2002 | Martin | 102/202.7 |

FOREIGN PATENT DOCUMENTS

| | | | |
|---|---|---|---|
| FR | 526830 | A | 10/1921 |
| FR | 532252 | A | 1/1922 |

OTHER PUBLICATIONS

International Search Report & Written Opinion mailed Jun. 25, 2009 in parent PCT application.

* cited by examiner

*Primary Examiner* — J. Woodow Eldred
(74) *Attorney, Agent, or Firm* — Jeffrey S. Melcher; Manelli Denison PLLC

(57) ABSTRACT

A powder charged rock cracker cartridge (1) comprises a substantially cylindrical outer sleeve (2) with an end wall in a first end (3); a plug (4) which, enclosing said outer sleeve, is inserted into and is secured in an opposite second end of the outer sleeve; a main chamber (5) in the outer sleeve (2) between said end wall and said plug, which main chamber is filled with a blasting powder charge (6); a substantially cylindrical inner sleeve (7), which is coaxial with the outer sleeve (2), is connected to said plug, and extends into the charge of blasting powder in the main chamber; and a central through hole (8) in said plug which communicates with the inner sleeve, which is closed in its inner end, which is inserted into the blasting powder charge. The hole in the plug and the inner sleeve in combination form a priming chamber (9) having a shape corresponding to the outer shape of a detonator (10), which can be trigged electrically and comprises an igniting powder charge. The inner sleeve has an inner wall (13) consisting of a plastic material. The thickness of the plastic wall and plastic material are selected such that the plastic wall in less than 25 ms (milliseconds) is penetrated by the pressure and the flame of fire which are formed when the detonator is ignited, thereby igniting the blasting powder charge.

14 Claims, 1 Drawing Sheet

Fig. 1
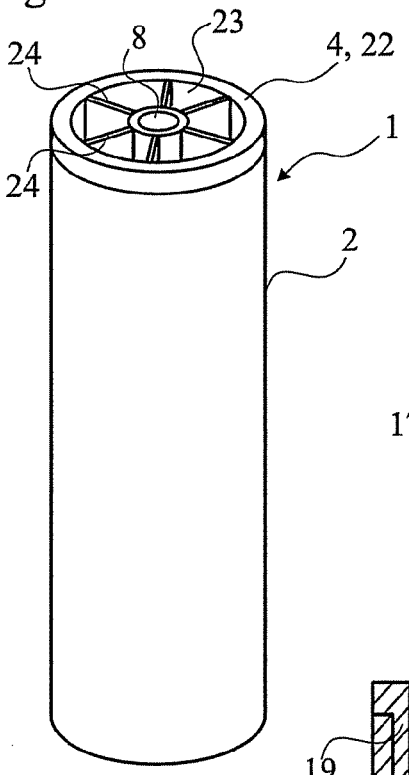
Fig. 2
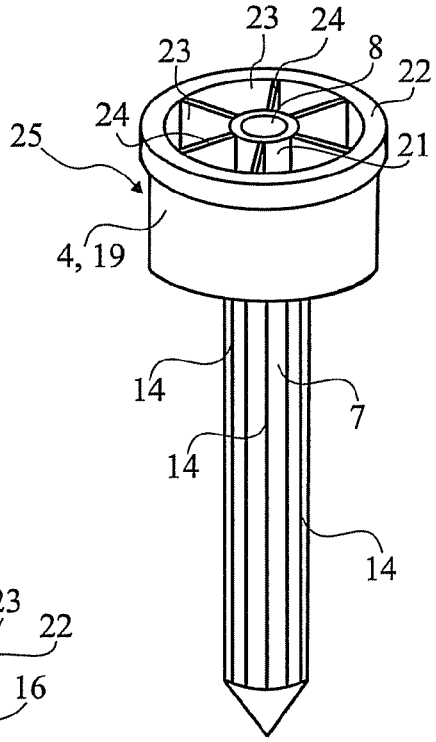
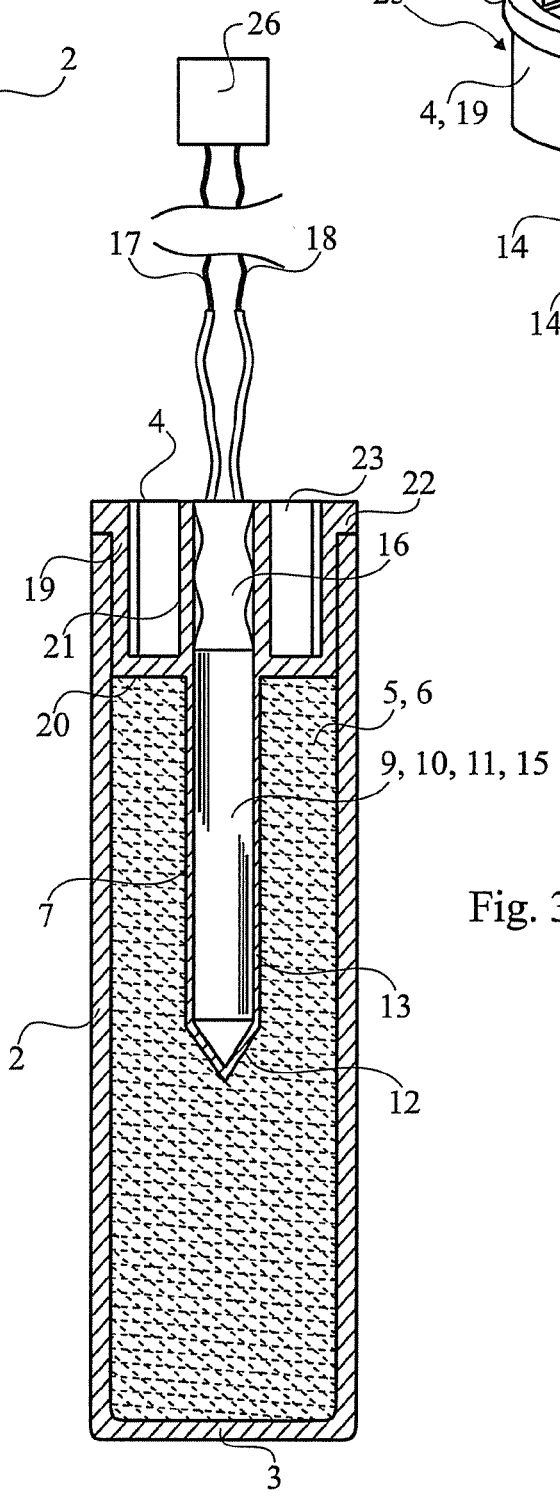
Fig. 3

POWDER CHARGED ROCK CRACKER CARTRIDGE

FIELD OF THE INVENTION

The invention relates to a powder charged rock cracker cartridge comprising a substantially cylindrical outer sleeve with an end wall in a first end; a plug which, enclosing said outer sleeve, is inserted into and secured in an opposite second end of the outer sleeve; a main chamber in the outer sleeve between said end wall and said plug, which main chamber is filled with a blasting powder charge; a substantially cylindrical inner sleeve, which is coaxial with the outer sleeve, is connected to said plug, and extends into the charge of blasting powder in the main chamber; and a central through hole in said plug which communicates with the inner sleeve, which is closed in its inner end, which is inserted into the blasting powder charge.

BACKGROUND ART

Rock cracker cartridges are known in prior art. SE 526830 discloses a cartridge which can be employed for cracking big rocks. The rock cracker cartridge is placed in a water filled drill hole, in which a chock wave is generated by means of a starting cartridge in the opening of the drill hole. The starting cartridge may be ignited manually by means of a rope at quite a short distance from the rock that shall be cracked. This well known cracker cartridge, as well as the system of which the cracker cartridge forms part, functions very well and is used to a considerable extent. The cartridge and the system, however, have some limitations. For example, electrical ignition can not be employed, and therefore neither delay blasting, i.e. blast set at intervals.

U.S. Pat. No. 5,763,816 discloses an explosive primer consisting of a container, which holds the explosive. Various explosives may be conceived, but in the first place the primer is intended to hold blasting gelatins and other high velocity explosives in a semiliquid or slurried form, which contain gellants and cross-linking agents in the explosive composition to gel inside the container to a desired consistency. The primer has a pierceable port, through which a detonator may be placed in direct contact with the explosive gel inside the container. In order to make this possible, the explosive gel either need to be compressed or not completely fill the container. It is not clear which of these alternatives that shall apply. However, the design of the primer disclosed requires that the detonator forcedly is pressed into a short tunnel and is caused to penetrate its bottom, which is weakened for that purpose, whereupon the detonator is pressed into the explosive charge which necessarily need either to be compressed or pressed aside to leave place for the detonator. This principle, however, makes assembling the primer a hazardous work. But unpriming the cartridge, a work which frequently need to be performed on working places, e.g. road working sites, would also be more or less hazardous, depending on the explosive that is employed, as the explosive will be exposed through the pierced port, once the detonator is withdrawn. If the explosive would consist of for example gun powder, as according to the present invention, it could run out, but also inhaling it from the open cartridge would be dangerous to health.

BRIEF DISCLOSURE OF THE INVENTION

It is the purpose of the present invention to provide a powder charged rock cracker cartridge which involves improvements over the above cited prior art, the detonation of which can be trigged electrically with or without delay. It is also an object that the cracker cartridge shall satisfy the requirements of lowest explosive classification, which allows transportation and storing without those rigorous safety rules which apply for higher explosive classifications. It is also an object of the invention to provide a cracker cartridge which is easy to manufacture and easy to use, including easy to prime as well as to unprime safely on the working place.

These and other objectives, advantages and aspects of the invention can be satisfied therein that the invention is characterized by what is stated in the appending claim 1. Other features and aspects of the invention are defined by the independent patent claims or are evident from the description of a preferred embodiment.

BRIEF DESCRIPTION OF DRAWINGS

In the following description of a preferred embodiment, reference will be made to the accompanying drawings, in which FIG. 1 shows a cracker cartridge according to the invention prior to priming in a view obliquely from above, FIG. 2 shows, at a larger scale, an insert unit, which in FIG. 1 is shown inserted in the upper end of the cracker cartridge, and FIG. 3 is longitudinal cross section through the primed cracker cartridge.

DESCRIPTION OF PREFERRED EMBODIMENT

The unprimed cracker cartridge 1, FIG. 1, consists of only two parts; an outer plastic sleeve 2 and an insert unit 25, FIG. 2, which in turn consists of a plug 4 and an inner sleeve 7. The plug 4 and the inner sleeve 7 consist, according to the embodiment, of an acetal plastic material, more specifically of an acetal (POM)-copolymer and are mould jointly to form an integrated unit.

The outer sleeve 2 is made of so called ABS-plastic according to the invention and has the shape of an elongated circular-cylindrical tube with a flat end wall 3. The interior of the outer sleeve 2 forms a main chamber 5 which is filled with a blasting powder charge 6.

The plug 4 has circular-cylindrical outer wall 19, a flat, annular end wall 20, which faces the main chamber 6 and is pressed against the powder charge 6, and a tubular portion 21 which defines a through hole 8, which is coaxial with the outer sleeve 2. Radial beams 24 extend between the tubular portion 21 and the cylindrical wall. Wedge-shaped, material saving recesses between the beams 24 are designated 23. An upper flange is designated 22.

The inner sleeve 7, which is coaxial with the outer sleeve 2, extends from the flat end wall 20 of the plug 4 into the blasting powder charge 6 in the outer sleeve to a significant depth in the powder charge as is illustrated in FIG. 3. The inner sleeve 7 has a very thin wall 13. It may optionally be provided with longitudinal, external stiffening protrusions 14 in order to increase its strength. Its cylindrical inside surface is completely smooth. Its nose portion 12 is tapered. More specifically, the nose portion 12 is tapered at an acute angle according to the disclosed embodiment.

The plug 4 is pressed with some force into the mouth section of the outer sleeve 2 so far that the flange 22 abuts the upper edge of the outer sleeve 2 and the flat end wall 20 of the plug with some pressure contacts the blasting powder charge 6. When entering the insert unit 25, the inner sleeve 7 will be pressed into the blasting powder charge 6, which is facilitated by its pointed nose portion 12. The amount of powder of the blasting powder charge 6 is adapted to the space which shall accommodate the powder such that the powder charge 6 will be compacted to some degree, which is advantageous because that prevents the powder from moving to any essential degree during transportation, and it also guarantees a good contact between the outer surface of the inner sleeve 7 and the powder. On the other hand the pressure exerted by the insert unit 25 is not exaggerated such that the thin wall 13 of the inner sleeve 7 is damaged or pressed together to any significant degree.

In the thus assembled cracker cartridge 1, the interior inner sleeve forms a direct continuation of the through hole 8 in the plug 4 and it also has the same cross section shape and area as the hole 8. This means that the hole 8 and the space in the inner sleeve 7 in combination form an integrated chamber, denominated priming chamber 9. In the priming chamber 9, that section of the priming chamber which is defined by the inner sleeve 7 is referred to as igniting chamber 11 in this context.

When priming the rock cracker cartridge, which is carried out on the blasting site, a detonator 10 is entered into the priming chamber 9. The detonator 10 contains an ignition agent which can be ignited electrically, normally also a delay element, and an igniting powder charge, all of which are enclosed in a cylindrical capsule 15 of aluminium. When the detonator 10 is entered into the priming chamber 9, FIG. 3, at least that part of the capsule 15 which contains the igniting powder charge is direct contact with the inside surface of the inner sleeve 7 in the igniting chamber 11. When the igniting powder charge is ignited by an electric spark, it develops such a high pressure and such a violent flame of fire that the thin-walled inner sleeve 7 will be torn to pieces and the blasting powder charge 6 is ignited within a negligible period of time.

When very large rocks or parts of steady rock shall be cracked, delay blasting of the cracker cartridges, i.e. blast set at intervals, may be employed in a manner known per se. The delay times may be from 25 ms (0.025 second) or more. Even if 25 ms is quite a short period of time, it is yet longer that the time it will take for the detonator 10, when ignited, to ignite the blasting powder charge 6. The expression "negligible period of time" above therefore shall be interpreted as a period of time which is shorter than 25 ms, preferably significantly shorter than 25 ms. When blasting a large number of cracker cartridges according to the invention, the delay times may e.g. be 25 ms, 50 ms, 75 ms, etc, which are indicated through well known symbols on the parts 26 of the electric conduits 17, 18 which shall be connected to a joint electric power source.

The cracker cartridge 1 of the invention may advantageously be manufactured in a number of different standard lengths, corresponding to different, desired rock cracking forces.

The invention claimed is:

1. A rock cracking assembly comprising a powder charged rock cracker cartridge and a detonator which can be triggered electrically and comprising an igniting powder charge, the rock cracker cartridge comprising:

a substantially cylindrical outer sleeve comprising a plastic material with an end wall in a first end;

a plug comprising plastic material which, enclosing said outer sleeve, is inserted into and secured in an opposite second end of the outer sleeve;

a main chamber in the outer sleeve between said end wall and said plug, which main chamber is filled with a blasting powder charge, an end of the plug pressed against the blasting powder charge;

a substantially cylindrical inner sleeve, which is coaxial with the outer sleeve and, connected to said plug, extends and is pressed into the blasting powder charge, the amount of the blasting powder charge being adapted to the space which accommodates the powder such that the blasting powder charge is compacted to some degree, and a central through hole in said plug which communicates with the inner sleeve, which is closed in its inner end, which is inserted into the blasting powder charge, wherein the hole in the plug and the inner sleeve in combination form a priming chamber having a shape corresponding to the outer shape of the detonator, and wherein, in the assembled rock cracking assembly;

an inner portion of the priming chamber, corresponding to the region of the inner sleeve, defining an ignition chamber, accommodates that portion of the detonator which contains the igniting powder charge; and the inner sleeve comprising a plastic material, the thickness of the inner sleeve being selected such that the inner sleeve in less than 25 ms (milliseconds) is penetrated by the pressure and the flame of fire which are formed when the detonator is ignited, thereby igniting the blasting powder charge.

2. The rock cracking assembly according to claim 1, wherein the plug and the inner sleeve are molded jointly to form an integrated unit.

3. The rock cracking assembly according to claim 1, wherein the inner sleeve has a tapered nose portion.

4. The rock cracking assembly according to claim 1, wherein the inner sleeve has a thickness of 0.05-2.0 mm.

5. The rock cracking assembly according to claim 4, wherein the inner sleeve has a thickness is 0.5-1.5 mm.

6. The rock cracking assembly according to claim 4, wherein the inner sleeve is provided with external, longitudinal stiffening protrusions, while the inside surface of the sleeve is smooth.

7. The rock cracking assembly according to claim 1, wherein the inner sleeve is at least twice as long as the length of said plug in the axial direction thereof.

8. The rock cracking assembly according to claim 7, wherein the inner sleeve extends into the blasting powder charge in the main chamber to a depth corresponding to at least ⅕ of the length of the main chamber.

9. The rock cracking assembly according to claim 1, wherein the inner sleeve is made of an acetal (POM)-copolymer.

10. The rock cracking assembly according to claim 1, wherein an electrically trigged detonator is provided in the priming chamber.

11. The rock cracking assembly according to claim 10, wherein the detonator contains an ignition agent which can be ignited electrically, a delay element, and the ignition powder charge, all of which are enclosed in a cylindrical capsule, and that at least that portion of the capsule which contains the ignition powder charge makes direct contact with the inside surface of the inner sleeve.

12. A rock cracking assembly comprising:

a substantially cylindrical outer sleeve comprising a first plastic material with an end wall in a first end;

a plug comprising a second plastic material enclosing the outer sleeve inserted into and secured in an opposite second end of the outer sleeve;

a main chamber in the outer sleeve defined between the end wall and the plug, which main chamber is filled with a compacted gun powder charge, an end of the plug pressed against the gun powder charge;

a substantially cylindrical inner sleeve coaxial with the outer sleeve and being molded integrally with the plug, the inner sleeve comprising the second plastic material, a first end of the inner sleeve opposite the plug being sealed, the inner sleeve being pressed into the gun powder charge so that the inner sleeve extends into the gun powder to a depth of at least ⅕ of the length of the main chamber, and the amount of the gun powder charge being selected so that the gun powder charge is compacted when the sleeve is inserted into the gun powder charge, the plug having a central through hole which communicates with the inner sleeve, wherein the hole in the inner sleeve defining a priming chamber;

a detonator which can be triggered electrically and comprising an igniting powder charge being disposed within the priming chamber;

an inner portion of the priming chamber defining an ignition chamber containing a portion of the detonator which contains the igniting powder charge; and the inner sleeve being constructed such that the inner sleeve in less than 25 ms (milliseconds) is penetrated by the pressure and the flame of fire which are formed when the detonator is ignited, thereby igniting the gun powder charge.

13. A method of making a rock cracking assembly comprising:

providing a substantially cylindrical outer sleeve comprising a first plastic material with an end wall in a first end, the outer sleeve defining a main chamber;

adding a blasting powder charge to the main chamber;

inserting a plug having a substantially cylindrical inner sleeve connected thereto so that the inner sleeve penetrates at least to a depth of at least ⅕ of the length of the main chamber into the blasting charge and compacting the blasting charge, and sealing the main chamber, wherein the plug having a central through hole which communicates with the inner sleeve, the inner sleeve being sealed at an end opposite the plug and defining a priming chamber; and inserting a detonator that can be triggered electrically and comprising an igniting powder charge into the priming chamber, and the inner sleeve being constructed such that the inner sleeve in less than 25 ms (milliseconds) is penetrated by the pressure and the flame of fire which are formed when the detonator is ignited, thereby igniting the blasting powder charge.

14. A method according to claim 13, further comprising using gun powder as the blasting powder.

* * * * *